US010828547B2

(12) United States Patent
Herr

(10) Patent No.: US 10,828,547 B2
(45) **Date of Patent: *Nov. 10, 2020**

(54) SPORTS EQUIPMENT BAG

(71) Applicant: Philip C. Herr, Keller, TX (US)

(72) Inventor: Philip C. Herr, Keller, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/261,619

(22) Filed: Jan. 30, 2019

(65) Prior Publication Data

US 2019/0151738 A1 May 23, 2019

Related U.S. Application Data

(63) Continuation of application No. 16/041,201, filed on Jul. 20, 2018, now Pat. No. 10,201,742.

(60) Provisional application No. 62/535,679, filed on Jul. 21, 2017.

(51) Int. Cl.

| | |
|---|---|
| ***A45F 3/04*** | (2006.01) |
| ***A63B 71/00*** | (2006.01) |
| *A63B 102/18* | (2015.01) |
| *A45F 3/00* | (2006.01) |
| *A63B 102/20* | (2015.01) |
| *A63B 102/02* | (2015.01) |
| *A63B 102/24* | (2015.01) |
| *A63B 102/22* | (2015.01) |

(52) U.S. Cl.

CPC ..... *A63B 71/0036* (2013.01); *A45F 3/04* (2013.01); *A63B 71/0045* (2013.01); *A45F 2003/003* (2013.01); *A63B 2102/02* (2015.10); *A63B 2102/18* (2015.10); *A63B 2102/182* (2015.10); *A63B 2102/20* (2015.10); *A63B 2102/22* (2015.10); *A63B 2102/24* (2015.10); *A63B 2209/10* (2013.01); *A63B 2243/0066* (2013.01)

(58) Field of Classification Search

CPC .. A45F 3/04; A45F 3/042; A45F 3/045; A45F 3/06; A45F 2003/003

USPC ..... 224/650, 651, 652

See application file for complete search history.

(56) References Cited

U.S. PATENT DOCUMENTS

| | | | | |
|---|---|---|---|---|
| 4,227,710 | A | 10/1980 | Laub | |
| 4,466,124 | A | 8/1984 | Kirkham, Jr. | |
| 4,680,813 | A | 7/1987 | Glaeser | |
| 4,693,402 | A | 9/1987 | Comeau | |
| 4,884,731 | A * | 12/1989 | Sibley | A45F 3/04 224/651 |
| 4,890,731 | A | 1/1990 | Mroz | |
| 5,273,298 | A | 12/1993 | Brown, Sr. | |
| 5,779,112 | A * | 7/1998 | Krulik | A45C 9/00 224/155 |
| 5,803,332 | A | 9/1998 | Thompson | |
| 5,826,771 | A | 10/1998 | Peng | |
| 5,950,895 | A | 9/1999 | Zakarin | |
| 5,975,293 | A | 11/1999 | Fowler | |
| 6,053,340 | A | 4/2000 | Cameron | |
| 6,135,334 | A | 10/2000 | Seichter | |

(Continued)

*Primary Examiner* — Justin M Larson

(74) *Attorney, Agent, or Firm* — Vincent J. Allen; J. Andrew Reed; Carstens & Cahoon, LLP

(57) ABSTRACT

A sports bag configured as a backpack for use in storing gear is provided. The sports bag includes a main body having a pair of straps coupled to the top or back of the main body, and a pair of storage pouches coupled to the back and bottom of the main body, each pouch including a fastening member to provide access to the pouch, and each pouch including at least one strap to stow the pouch when not in use.

20 Claims, 3 Drawing Sheets

(56) References Cited

U.S. PATENT DOCUMENTS

| | | | | |
|---|---|---|---|---|
| 6,168,016 | B1 | 1/2001 | Lawson | |
| 6,193,034 | B1 | 2/2001 | Fournier | |
| 6,290,114 | B1 | 9/2001 | Berberian | |
| 6,367,674 | B1 | 4/2002 | Tabor | |
| 6,386,414 | B1 | 5/2002 | Kilduff | |
| 6,494,468 | B1 | 12/2002 | Inge | |
| 6,508,358 | B2 | 1/2003 | Cheng | |
| 6,561,329 | B2 | 5/2003 | Stobbs, II et al. | |
| 6,712,250 | B2 * | 3/2004 | Vigny | A45F 3/04 224/637 |
| 6,732,863 | B2 | 5/2004 | Speck | |
| 6,736,302 | B1 | 5/2004 | Brownlee | |
| 7,278,539 | B2 | 10/2007 | Souza | |
| 7,594,569 | B2 * | 9/2009 | Bass | A45C 7/0086 190/108 |
| 7,878,331 | B2 * | 2/2011 | Tauchen | A45C 3/00 190/109 |
| 8,074,853 | B1 | 12/2011 | Hirshberg | |
| 8,607,985 | B2 * | 12/2013 | Tauchen | A45C 3/00 190/109 |
| D709,689 | S | 7/2014 | Brunazzi et al. | |
| 8,820,523 | B1 | 9/2014 | Breza et al. | |
| 8,870,045 | B1 | 10/2014 | Aguirre | |
| 8,919,628 | B2 | 12/2014 | Jamlang | |
| 8,978,949 | B2 | 3/2015 | Arajakis | |
| 9,241,557 | B2 | 1/2016 | Abramowitz et al. | |
| 9,332,852 | B1 | 5/2016 | Milich et al. | |
| 9,981,175 | B2 | 5/2018 | DeLaRosa | |
| 10,201,742 | B1 * | 2/2019 | Herr | A63B 71/0036 |
| 2002/0101065 | A1 | 8/2002 | McCollum et al. | |
| 2002/0125285 | A1 | 9/2002 | Parks et al. | |
| 2003/0000984 | A1 | 1/2003 | Vick, III | |
| 2004/0118891 | A1 | 6/2004 | Esqueda | |
| 2004/0159691 | A1 | 8/2004 | Dingman et al. | |
| 2004/0195286 | A1 | 10/2004 | Greenhalgh et al. | |
| 2004/0244115 | A1 | 12/2004 | Adams et al. | |
| 2006/0151345 | A1 | 7/2006 | Coifing | |
| 2007/0017947 | A1 | 1/2007 | Fenton et al. | |
| 2007/0164070 | A1 | 7/2007 | Bevier | |
| 2007/0170219 | A1 | 7/2007 | Ballarta et al. | |
| 2007/0228091 | A1 | 10/2007 | Shawen | |
| 2008/0237288 | A1 | 10/2008 | Hamilton | |
| 2009/0184143 | A1 | 7/2009 | Witt et al. | |
| 2010/0205718 | A1 | 8/2010 | Eastep | |
| 2010/0243695 | A1 | 9/2010 | Vock | |
| 2015/0182007 | A1 | 7/2015 | Ponx | |
| 2015/0320181 | A1 | 11/2015 | Mondaca et al. | |
| 2016/0278507 | A1 | 9/2016 | Ponx | |
| 2016/0367018 | A1 | 12/2016 | Soto-Camacho et al. | |
| 2017/0215557 | A1 | 8/2017 | Buck et al. | |
| 2017/0251781 | A1 | 9/2017 | Wilson | |
| 2019/0151738 | A1 * | 5/2019 | Herr | A63B 71/0036 |

* cited by examiner

SPORTS EQUIPMENT BAG

RELATED APPLICATIONS

The present disclosure is a non-provisional conversion of, and thus claims priority to, U.S. Provisional Patent Application Ser. No. 62/535,679, filed Jul. 21, 2017, the entirety of which is incorporated herein by reference in its entirety for all purposes, and U.S. Utility patent application Ser. No. 16/041,201, filed Jul. 20, 2018, the entirety of which is incorporated herein by reference in its entirety for all purposes.

BACKGROUND

Technical Field

The embodiments herein relate generally to sports equipment bags.

Description of Related Art

Baseball and softball players utilize a variety of gear. In particular, baseball and softball catchers carry a facemask, helmet, shin guards, chest protector, batting helmet, bat, spikes and glove. Other sports can benefit from a bag to carry sports gear, such as cricket players, and in particular, a widget keeper who utilizes much of the same equipment as a baseball or softball player. These items together are bulky, heavy and a burden to transport from one location to another. Several sports equipment bags exist as disclosed in U.S. Patent Application Publication 2016/0278507, and U.S. Pat. Nos. 4,693,402 and 6,367,674. However, these equipment bags are not designed to accommodate and organize bulky baseball catcher's gear including a chest protector, shin guards, facemask, helmet, batting helmet bats, spikes and the like.

As such, there is a need in the industry for a sports bag that addresses the limitations of the prior art, which effectively stores baseball or softball catcher's gear including at least a chest protector and shin guards.

BRIEF SUMMARY

A sports bag configured as a backpack for use in storing gear is disclosed. The sports bag can include a main body having a pair of straps coupled to the top or back of the main body, and a pair of storage pouches coupled to the back and bottom of the main body, each pouch including a fastening member to provide access to the pouch, and each pouch including at least one strap to stow the pouch when not in use.

BRIEF DESCRIPTION OF THE DRAWINGS

The detailed description of some embodiments of the invention will be made below with reference to the accompanying figures, wherein the figures disclose one or more embodiments of the present invention.

DETAILED DESCRIPTION

An embodiment will now be described. While, baseball and softball players are referenced herein, other sports could utilize the invention claimed, including, but not limited to, cricket, field hockey, rugby, ice hockey, roller hockey, tennis, and other sports or activities utilizing equipment. In certain embodiments, a sports bag is configured as a backpack for storing sports gear. The sports bag can include a main body having a pair of straps coupled on or to the top or back of the main body. The main body can also include a pair of storage pouches coupled to the back and bottom of the main body. Each of these pouches can have a fastening member, such as a zipper, buttons, snaps, or other fasteners to provide access to the pouch. Additionally, the pouches can include at least one strap to secure the pouch(es) when not in use.

In certain examples, the backpack provides a lightweight and portable/manageable single unit gear carrying option that addresses a catcher's needs. The backpack allows a player to carry the additional catcher specific gear neatly without any loss of storage space for other equipment typically carried in a pack. In addition, the backpack allows the user to stow away the specific catcher's gear holding components when not in use.

Figure 1:
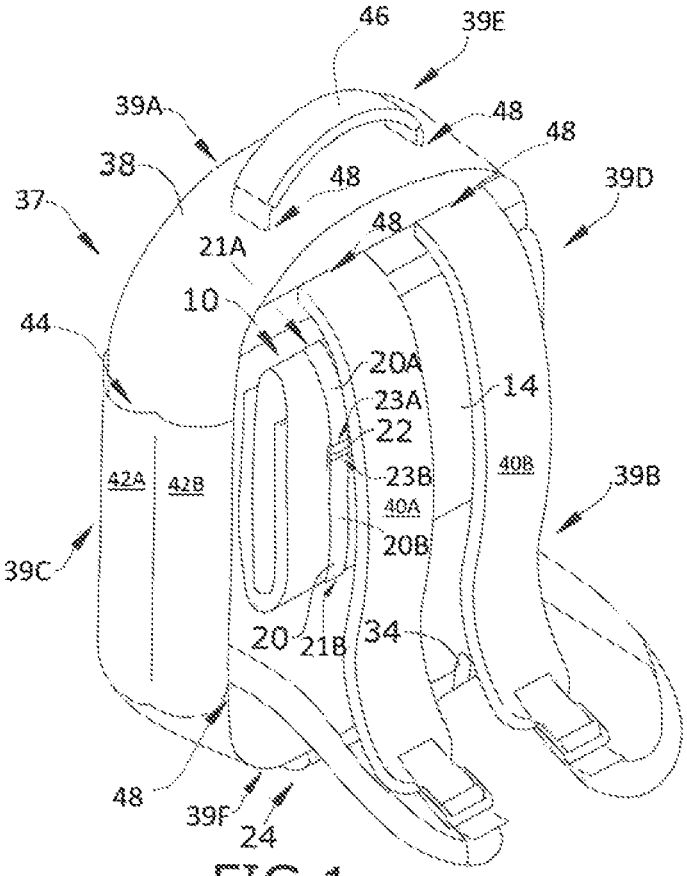
FIG. 1 is a top perspective view of a sports bag in accordance with an embodiment of the invention, with pouches shown in the stored position.

FIG. 1 is a top perspective view of a sports bag 38. The sports bag could have many different variations and configurations. In at least one version, the sports bag 38 is a back pack. The sports bag 38 may include at least one shoulder strap 40A and/or 40B (collectively shoulder strap(s) 40), and/or at least one handle 46. The shoulder strap(s) 40 and/or handle 46 can be coupled to the sports bag 38 through a plurality of connection point(s) 48. The connection point(s) 48 may include stitching, thread, hook and loop, adhesive, glue, button and slot, snaps, and/or other types of fasteners and/or connections or combinations thereof. The shoulder strap(s) 40, and/or handle 46 can allow a user, such as a sports player, to carry a variety of equipment with relative ease.

The sports bag 38 can include a chest protector pouch 10, shin guard pouch 24, and/or at least one flexible storage pouch(es) 42A and/or 42B (collectively flexible storage pouch(es) 42). The chest protector pouch 10, or first storage pouch can include a chest protector pouch rear panel 14 held in place by at least one adjustable chest protector pouch strap 20 or storage strap. The adjustable chest protector pouch strap(s) 20 can be secured utilizing stitching, thread, hook and loop, adhesive, glue, button and slot, snaps, buckles 22, and/or other types of fasteners and/or connections or combinations thereof, including securing to the sports bag and/or other strap(s). The sports bag 38 can include a main body 37, a front 39A, a back 39B, a first side 39C, a second side 39D, a top 39E, and a bottom 39F. The storage strap(s) (collectively 20) can have a first section 20A and a second section 20B with both being coupled to the main body. The first section 20A and the second section 20B can distal ends 21A and 21B respectively that can be coupled to the main body, and proximate ends 23A and 23B coupled by a securing mechanism such as, a buckle, snap, loop, button, hook and loop, or other securing mechanism or a combination thereof. The sports bag 38 can also include a shin guard pouch 24 configured to hold at least one shin guard (not illustrated).

Figure 2:
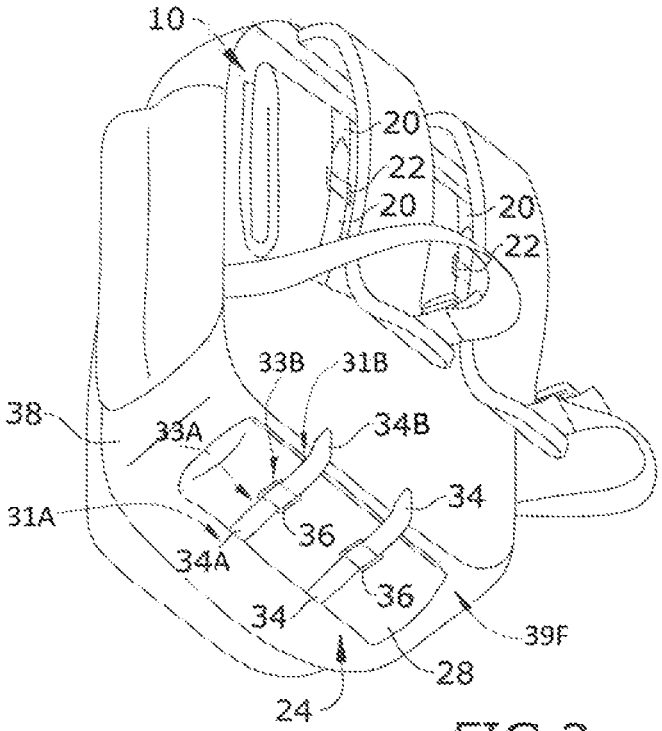
FIG. 2 is a bottom perspective view of a sports bag in accordance with an embodiment of the invention, with pouches shown in the stored position.

FIG. 2 is a bottom perspective view of a sports bag 38. The sports bag 38 can include a chest protector pouch 10, a shin guard pouch 24 or second storage pouch, at least one strap and/or handle such as 40A/40B, and at least one flexible storage pouch such as 42A/42B. The pouch(es) 10, 24, 42A and/or 42B may be coupled to the sports bag 38 through stitching, thread, hook and loop, adhesive, glue, button and slot, snaps, buckles, and/or other types of fasteners and/or connections or combinations thereof. In at least one version, the chest protector pouch 10, and/or the shin guard pouch 24 can be secured utilizing straps 20 and/or 34, and buckles 22 and/or 36. The straps 20 and/or 34 can in at least one version be considered at least one securing or storage strap(s) that can be adjusted to fit a particular size of equipment. The securing or storage strap(s) (collectively 20 or 34) can have a first section 20A/34A and a second section 20B/34B with both being coupled to the main body. The first section 20A/34A and the second section 20B/34B can distal ends 21A/31A and 21B/31B respectively that can be coupled to the main body, and proximate ends 23A/33A and 23B/33B coupled by a securing mechanism such as, a buckle, snap, loop, button, hook and loop, or other securing mechanism or a combination thereof. The sports bag 38 can also include a shin guard pouch 24 configured to hold at least one shin guard (not illustrated).

The chest protector pouch 10, the shin guard pouch 24, and/or the flexible storage pouch(es) 42A/42B can include multiple sections to provide protection and/or storage for multiple pieces of sports equipment such as, a chest protector, multiple portions of a chest protector, at least one shin guard, a bat, a racket, a mallet, shoe(s), cleat(s), other sports equipment, and/or combinations thereof. In at least one version, the chest protector pouch 10 and/or the shin guard pouch 24 can be rolled and/or folded to hold sports equipment in a compact storage configuration. The storage configuration allows for the chest protector pouch 10 and/or the shin guard pouch 24 to be reduced in size and configuration, and reduce the size of the sports bag 38 overall.

In an alternative example, the straps 20/34 that hold the gear pouches 10/24 when closed are capable of performing as cinch down straps as well as storage straps. The cinch down configuration for the straps can allow a buckle to or other coupling or connecting device to be threaded through at least one strap. It shall be appreciated that the sew in location for the chest protector may be modified. All strap placements can be adjusted to accommodate different closed pouch storage configurations.

Figure 3:
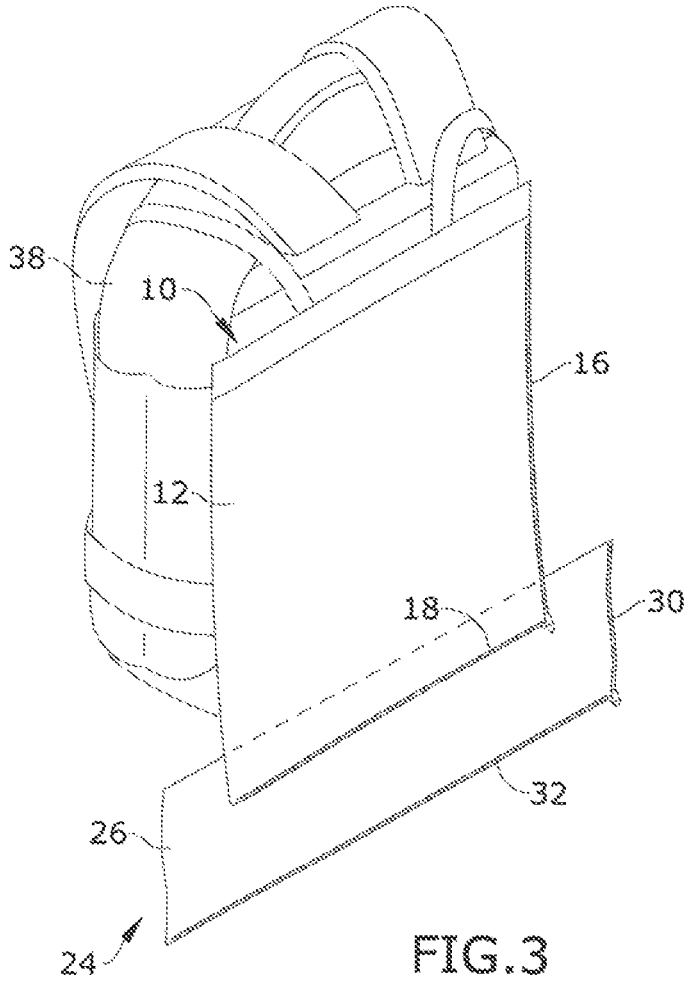
FIG. 3 is a perspective view of a sports bag in accordance with an embodiment of the invention, with pouches unrolled, and straps pulled back for clarity.

FIG. 3 is a perspective view of a sports bag 38 with a chest protector pouch 10 and/or a shin guard pouch 24. As shown in FIG. 3, the pouch(es) 10/24 can be unfolded and/or unrolled to allow for sports equipment to be inserted within the pouch(es) 10/24.

The chest protector pouch 10 can include a chest protector pouch front panel 12, a chest protector pouch rear panel (not illustrated), a chest protector pouch vertical zipper 16, and/or a chest protector pouch horizontal zipper 18. In at least one version, the chest protector pouch 10 utilizes at least one zipper to secure the front panel 12 and the rear panel (not illustrated) together along at least one edge of their respective perimeters. The remaining edges can be secured through stitching, thread, hook and loop, adhesive, glue, button and slot, snaps, buckles, and/or other types of fasteners and/or connections or combinations thereof.

The shin guard pouch 24 can include a shin guard pouch front panel 26, a shin guard pouch rear panel (not illustrated), a shin guard pouch vertical zipper 30, and/or a shin guard pouch horizontal zipper 32. In at least one version, the shin guard pouch 24 utilizes at least one zipper to secure the front panel 26 and the rear panel (not illustrated) together along at least one edge of their respective perimeters. The remaining edges can be secured through stitching, thread, hook and loop, adhesive, glue, button and slot, snaps, buckles, and/or other types of fasteners and/or connections or combinations thereof.

Figure 4:
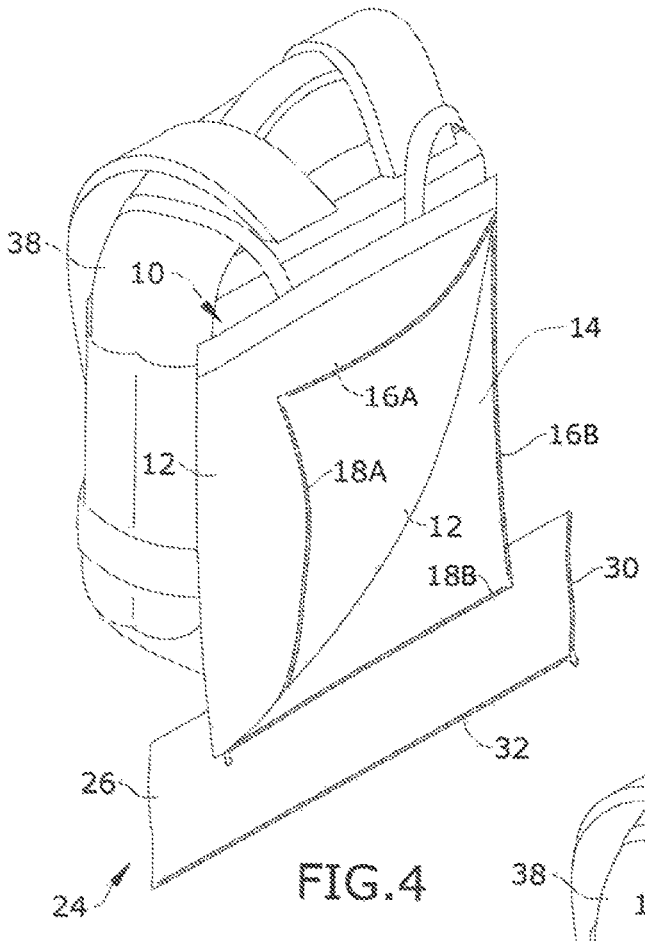
FIG. 4 is a perspective view of a sports bag in accordance with an embodiment of the invention with pouch unzipped and opened.

FIG. 4 is a perspective view of a sports bag 38 with an open chest protector pouch 10. The chest protector pouch 10 can include a chest protector pouch front panel 12, a chest protector pouch rear panel 14, a chest protector pouch vertical zipper 16, and/or a chest protector pouch horizontal zipper 18. In at least one version, the chest protector pouch 10 utilizes at least one zipper to secure the front panel 12 and the rear panel 14 together along at least one edge of their respective perimeters. The remaining edges can be secured through stitching, thread, hook and loop, adhesive, glue, button and slot, snaps, buckles, and/or other types of fasteners and/or connections or combinations thereof. For example, the chest protector pouch 10 may have two zippers 16/18 running along two edges of the pouch 10. The zippers may have one side 16A and 18A coupled to the front panel 12, and one side 16B and 18B coupled to the rear panel 14. Each side of the zippers 16 and 18 can be coupled and/or fastened to the front panel 12, or rear panel 14 through stitching, thread, hook and loop, adhesive, glue, and/or other types of fasteners and/or connections or combinations thereof. In at least one version, the zipper(s) can be replaced by fasteners such as, but not limited to, buttons, snaps, hook and loop, or other fasteners, or combinations thereof.

Figure 5:
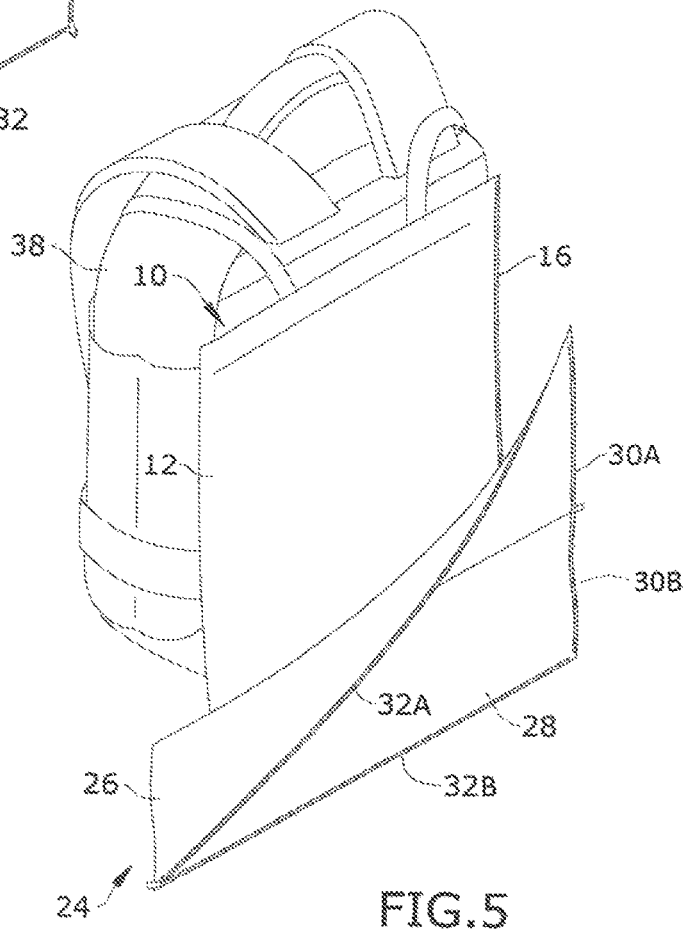
FIG. 5 is a perspective view of a sports bag in accordance with an embodiment of the invention with pouch unzipped and opened.

FIG. 5 is a perspective view of a sports bag 38 with an open shin guard pouch 10. The shin guard pouch 24 can include a shin guard pouch front panel 26, a shin guard pouch rear panel 28, a shin guard pouch vertical zipper 30, and/or a shin guard pouch horizontal zipper 32. In at least one version, the shin guard pouch 24 utilizes at least one zipper to secure the front panel 26 and the rear panel 28 together along at least one edge of their respective perimeters. The remaining edges can be secured through stitching, thread, hook and loop, adhesive, glue, button and slot, snaps, buckles, and/or other types of fasteners and/or connections or combinations thereof. For example, the shin guard pouch 24 may have two zippers 30/32 running along two edges of the pouch 24. The zippers may have one side 30A and 32A coupled to the front panel 26, and one side 30B and 32B coupled to the rear panels 28. Each side of the zippers 30 and 32 can be coupled and/or fastened to the front panel 26, or rear panel 28 through stitching, thread, hook and loop, adhesive, glue, and/or other types of fasteners and/or connections or combinations thereof.

In certain embodiments, the sports bag can include one or more of the following: a lightweight, 1.1 oz. (31.18 grams) 30 Denier, breathable, water resistant Clima-Fit, 100% Polyester fabric for the main body and/or the pouch(es), polyester zippers for the fastening and/or coupling of the various sections and pouch(es), hook and loop straps for securing the pouch(es), polyester general purpose thread for connecting and coupling the main body, straps, and pouch(es), and backing fabric made from nylon Cordura 330 Denier for the main body and/or pouch(es).

The pouch(es) or alternatively carry pockets can be made of a lightweight, 1.1 oz. 30 Denier, breathable, water resistant Clima-Fit, 100% Polyester fabric. The pouch(es) or carry pocket(s) can have, in one version, one horizontal zipper and one vertical zipper. Backing fabric can be used to anchor the pouches to the main body by using polyester thread. The polyester thread can be used in the sewing of all components. Hook and loop straps may be cut and sewn into the sports bag in such a fashion to permit each pouch to be rolled up and stowed in place when not in use. The Cordura fabric can be sewn to the main body from inside the chest protector storing pouch and/or shin guard storing pouch. Zippers may be sewn along the edges of the pouches for easy insertion and removal of the equipment. Hook and loop straps may be sewn into the main body and attached at opposite ends so as to secure the equipment pouches. The hook and loop straps serve as the equipment pouch storage straps when the pouches are not in use.

In at least one version, the chest protector storing pouch dimensions are approximately 16" across the top with a 3" panel at the top of the pouch, the width of the fabric connecting the front pouch fabric to the back pouch fabric. The pouch length is approximately 21½" long. The vertical zipper is approximately 20" long. The bottom of the pouch is approximately 17½" across and has a zipper sewn in horizontally at a length of approximately 17".

In at least one version, the shin guard storing pouch is constructed with 2 panels of fabric. The large end width is approximately 12½" and the narrow end width is approximately 10½". The length of the pouch is approximately 26½". A 11¾" zipper is sewn into the wide end while a 25" zipper is sewn into the length of the pouch. There is an unzipped area length wise of 1½" at the point at which both zippers converge at their closing point.

In at least one version, the chest protector straps are sewn in through the top and bottom of the chest protector backing material. The straps are approximately 18" long and are sewn in vertically, opposite each other. The straps are hook and loop straps. Shin guard pouch straps are sewn into the base of the bag. The straps are approximately 4" apart from the center point of the base of the bag. Each of the two approximately 18" long straps are to be secured vertically to the base of the bag as you look at the base. In each case, all straps are sewn into the backing material underneath the pouches.

In operation, the sports bag can be used by releasing the storage straps and unfolding the pouches. Each zipper may be opened to permit the appropriate piece of gear to be inserted into the appropriate pouch, and then the pouches can be zippered closed. The user can then carry the sports bag on his/her back with the gear neatly stored. When the gear needs to be removed from the backpack, the zippers can be unzipped and the gear removed. The zippers can be left open or closed when the gear is not stored in the pouches, the pouches can then be folded and the storage straps can be utilized to neatly tuck the pouches into storage positions.

A method of using a sports bag can include unsecuring a fastening member of securing at least one storage pouch coupled to a main body of the sports bag in a storage configuration. The at least one storage pouch can then be opened via at least one zipper, allowing sports gear to be inserted in the at least one storage pouch. The at least one storage pouch can then be closed utilizing the at least one zipper.

It shall be appreciated that the components of the backpack described in several embodiments herein may comprise any alternative known materials in the field and be of any color, size and/or dimensions. It shall be appreciated that the components of the backpack described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

While this disclosure has been particularly shown and described with reference to preferred embodiments, it will be understood by those skilled in the art that various changes in form and detail may be made therein without departing from the spirit and scope of the invention. The inventor expects skilled artisans to employ such variations as appropriate, and the inventor intends the invention to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

While various embodiments in accordance with the principles disclosed herein have been described above, it should be understood that they have been presented by way of example only, and not limitation. Thus, the breadth and scope of this disclosure should not be limited by any of the above-described exemplary embodiments, but should be defined only in accordance with any claims and their equivalents issuing from this disclosure. Furthermore, the above advantages and features are provided in described embodiments, but shall not limit the application of such issued claims to processes and structures accomplishing any or all of the above advantages.

Additionally, the section headings herein are provided for consistency with the suggestions under 37 C.F.R. 1.77 or otherwise to provide organizational cues. These headings shall not limit or characterize the invention(s) set out in any claims that may issue from this disclosure. Specifically, and by way of example, although the headings refer to a "Technical Field," the claims should not be limited by the language chosen under this heading to describe the so-called field. Further, a description of a technology as background information is not to be construed as an admission that certain technology is prior art to any embodiment(s) in this disclosure. Neither is the "Brief Summary" to be considered as a characterization of the embodiment(s) set forth in issued claims. Furthermore, any reference in this disclosure to "invention" in the singular should not be used to argue that there is only a single point of novelty in this disclosure. Multiple embodiments may be set forth according to the limitations of the multiple claims issuing from this disclosure, and such claims accordingly define the embodiment(s), and their equivalents, that are protected thereby. In all instances, the scope of such claims shall be considered on their own merits in light of this disclosure, but should not be constrained by the headings set forth herein.

The invention claimed is:

1. A sports bag comprising:

a main body comprising a first side, a second side, a front, a back, a top, and a bottom;

a first storage pouch coupled to the back of the main body, the first storage pouch comprises a front panel, a rear panel, and at least one fastening member for coupling the front and rear panels together; and at least one storage strap comprised of a first section with a distal end coupled to the main body above the first storage pouch and a second section with a distal end coupled to the main body below the first storage pouch and each section having a proximal end coupled to their respective distal ends by a securing mechanism that allows the first storage pouch to be secured in a storage configuration by the at least one storage strap.

2. The sports bag of claim 1, further comprising a second storage pouch coupled to the bottom of the main body.

3. The sports bag of claim 2, wherein the second storage pouch comprises a front panel and a rear panel.

4. The sports bag of claim 2, wherein the second storage pouch further comprises at least one fastening member.

5. The sports bag of claim 2, wherein the second storage pouch is secured by at least one storage strap and securing mechanism.

6. The sports bag of claim 1, wherein the sports bag further comprises at least one flexible storage pouch.

7. The sports bag of claim 1, wherein the sports bag further comprises at least one handle.

8. A sports bag comprising:

a main body of a fabric material including a first side, a second side, a top, a bottom, a front, and a back;

a first storage pouch of the fabric material coupled to the back of the main body, the first storage pouch comprises a front panel, a rear panel, and at least one fastening member for coupling the front and rear panels together; and at least one storage strap comprised of a first section with a distal end coupled to the main body and a proximal end with a first securing mechanism, and a second section with a distal end coupled to the main body and a proximal end with a second securing mechanism that allows the first storage pouch to be secured in a storage configuration by the at least one storage strap.

9. The sports bag of claim 8, wherein the first storage pouch is of a second fabric material.

10. The sports bag of claim 8, further comprising a second storage pouch of a second fabric material coupled to the bottom of the main body.

11. The sports bag of claim 8, wherein the second side is coupled to the top, the bottom, the front and the back of the main body.

12. The sports bag of claim 8, wherein the front is coupled to the top, the bottom, the first side, and the second side of the main body.

13. The sports bag of claim 8, wherein the back is coupled to the top, the bottom, the first side, and the second side of the main body.

14. The sports bag of claim 10, wherein the second storage pouch of fabric further comprises a front panel, and a rear panel.

15. The sports bag of claim 8, wherein the at least one fastening member is a zipper.

16. A method of using a sports bag comprising:

unsecuring at least one storage strap of at least one storage pouch coupled to a back of a main body of the sports bag, wherein the at least one storage strap secures the at least one storage pouch in a storage configuration prior to the unsecuring;

opening the at least one storage pouch to provide access into the at least one storage pouch via at least one fastening member;

inserting sports gear into the at least one storage pouch;

closing the at least one storage pouch via the at least one fastening member; and securing the at least one storage pouch in a storage configuration with the at least one storage strap.

17. The method of claim 16, wherein the at least one storage pouch is configured to receive a chest protector.

18. The method of claim 16, wherein the at least one storage pouch is configured to receive at least one shin guard.

19. The method of claim 16, wherein the at least one storage pouch further comprises a front panel, and a rear panel coupled together by the at least one fastening member.

20. The method of claim 16, wherein the at least one strap is further comprised of a first section and a second section each having a distal end coupled to the main body and a proximal end coupled to the distal end by a securing mechanism.

* * * * *